US005955939A

United States Patent [19]

Taylor

[11] Patent Number: 5,955,939

[45] Date of Patent: Sep. 21, 1999

[54] ALARM STATION PROTECTOR CAPABLE OF BEING ACCESSED BY DISABLED INDIVIDUALS

[76] Inventor: John A. Taylor, 2306 Airport Rd., Waterford, Mich. 48237

[21] Appl. No.: 08/782,547

[22] Filed: Jan. 10, 1997

[51] Int. Cl.[6] ..... G08B 00/00

[52] U.S. Cl. ..... 340/286.05; 340/287; 340/289; 200/50.1; 200/43.05; 200/52 R; 200/61.71; 200/61.73; 200/333; 200/547; 200/550

[58] Field of Search ..... 340/286.04, 286.05, 340/286.06, 287, 289; 200/50.01, 50.1, 43.01, 43.04, 43.05, 52 R, 61.62, 61.71, 61.73, 330, 333, 547, 550, 61.78, 61.79, 61.8, 48.3

[56] References Cited

U.S. PATENT DOCUMENTS

| | | | |
|---|---|---|---|
| 2,875,290 | 2/1959 | Shattow | 200/61.79 |
| 4,267,549 | 5/1981 | Taylor | 340/286.04 |
| 4,469,238 | 9/1984 | Ranalli | 200/61.62 |
| 4,742,190 | 5/1988 | Jacquet | 200/50.1 |

*Primary Examiner*—Jeffery A. Hofsass
*Assistant Examiner*—Julie B. Lieu
*Attorney, Agent, or Firm*—Gifford, Krass, Groh, Sprinkle, Anderson & Citkowski, P.C.

[57] ABSTRACT

An improved alarm activation station protector for use with a depressible alarm activating member and which is capable of being accessed by individuals with varying degrees of hand and arm disability. A wall mounted frame member is formed in a generally "U" shape with first, second and third interconnecting sides and a centrally open area for receiving the depressible alarm activating member. A transparent protective cover includes first, second and third sides which slidably engage the frame member and an arcuate shaped body which permits the cover to be arranged over the alarm. Slidably interlocking means established between the frame member and protective cover permit the cover to be pushed upwardly with the use of a stubbed hand or arm portion and without the need of fingers to grasp the cover. The cover is elevated to a desired height, at which point the individual can activate the alarm by depressing the exposed alarm member inwardly. As the cover is elevated to the desired height, an optional local and audible alarm device sounds to deter false fire alarms. The protector device may further display a visual signal for notifying the hearing impaired and may further provide physical and/or mechanical protection as dictated by NHFPA 72. The protector device may further be configured for outdoor use.

12 Claims, 8 Drawing Sheets

ALARM STATION PROTECTOR CAPABLE OF BEING ACCESSED BY DISABLED INDIVIDUALS

BACKGROUND OF THE INVENTION

1. Field of the Invention

The present invention relates generally to protective covering devices for conventional watt mounted alarm assemblies and, more specifically, to an improved alarm station protector for an alarm assembly which is capable of being accessed by disabled or handicapped individuals, specifically individuals with very limited hand and arm ability.

2. Description of the Prior Art

Conventional alarm activation station assemblies which are activated to signal the existence of fire, burglary and a host of other possible occurrences for which an alarm signal would be appropriate are well known in the art. Such alarm assemblies are typically incorporated into a wall mounted unit as which is positioned so as to be accessible to most individuals. The unit typically includes a face plate into which is built an alarm handle or wall mounted pull station. In order to set off the alarm, the handle is typically grasped by the user's fingers and is pulled in the direction indicated.

A protective cover may also be provided and is mounted in an overlaying fashion with respect to the alarm assembly. Typical protective covers have in the past included metallic shields which are formed in a criss-cross grid shape and are mounted to the wall surrounding the alarm or, more recently, in transparent and high strength, heavy duty polymers. In each instance, the shielding cover must be secured or otherwise attached around the alarm device so that it may be quickly detached or opened to reveal the alarm and to quickly permit the user to activate it.

An example of an alarm protection device is illustrated in applicant's previous U.S. Pat. No. 4,267,549, which teaches a pull station protector including a wall mounted framing member surrounding the alarm station and a transparent covering member which is pivotally attached to the framing member and is capable of being pivoted about an upper hinge by a user to reveal the alarm. The purpose of applicant's previous device is in pat to protect the alarm activation station from vandalism and this may be further accomplished by incorporating a portable alarm into the protector assembly itself which is set off by the user pivoting the covering member to its upward position and without the user necessarily setting off the actual alarm.

A shortcoming of the prior art, both in the instances of pull station alarm designs as well as in the construction of the displaceable protective covers which surround them, are the difficulties experienced by disabled or handicapped persons in displacing the covering devices and in setting off the alarms. This is particularly evident in instances where the individual is missing most or all of his or her fingers and must rely upon a stubbed hand or arm with which to activate the alarm.

SUMMARY OF THE PRESENT INVENTION

The present invention is an improved alarm activation station protector which is capable of being accessed by individuals with varying degrees of hand and arm disabilities. The alarm activation station protector overlays a wall mounted alarm assembly which includes a depressible activating member. The alarm station protector includes a frame member formed in a generally U-shaped fashion and mounted to the wall around the alarm assembly so that the depressible activating member is received within a centrally open area of the frame member. A transparent protective cover is slidingly engaged over the wall mounted frame members between a first position in which the protective cover overlays and shields the alarm activating member and a second position in which the protective cover is slidably displaced away from and exposes the alarm.

The foundation of the present invention is the provision of a covering member for an alarm which is capable of being displaced by a disabled individual, particularly one without the use of his or her hands or fingers, and which complies filly with the regulations of the American with Disabilities Act (ADA). The purpose of such an alarm station protector as is provided by the present invention is to assist in preventing accidental or malicious activation of the alarm. As an additional feature, a horn assembly is incorporated into the protector and, upon sliding the protective cover upwardly, emits a high-pitched piercing alarm. The provision of the built-in alarm feature helps to insure that only an individual with a present intention of actuating the main alarm will proceed with sliding the protective cover to its engaged position and thus the station protector functions as an effective deterrent to vandalism and/or malicious alarm activation.

BRIEF DESCRIPTION OF THE DRAWINGS

Reference is now made to the attached drawings, when read in combination with the following specification, wherein like reference numerals refer to like parts throughout the several views, and in which:

FIG. 9*a* is a sectional view of a top plate of the alarm activation station protector according to the embodiment of FIG. 7 and FIGS. 9*b* and 9*c* are further side views taken along lines 9*b*—9*b* and 9*c*—9*c* of the top plate of FIG. 9*a.

DETAILED DESCRIPTION OF THE PREFERRED EMBODIMENTS

Figure 1:
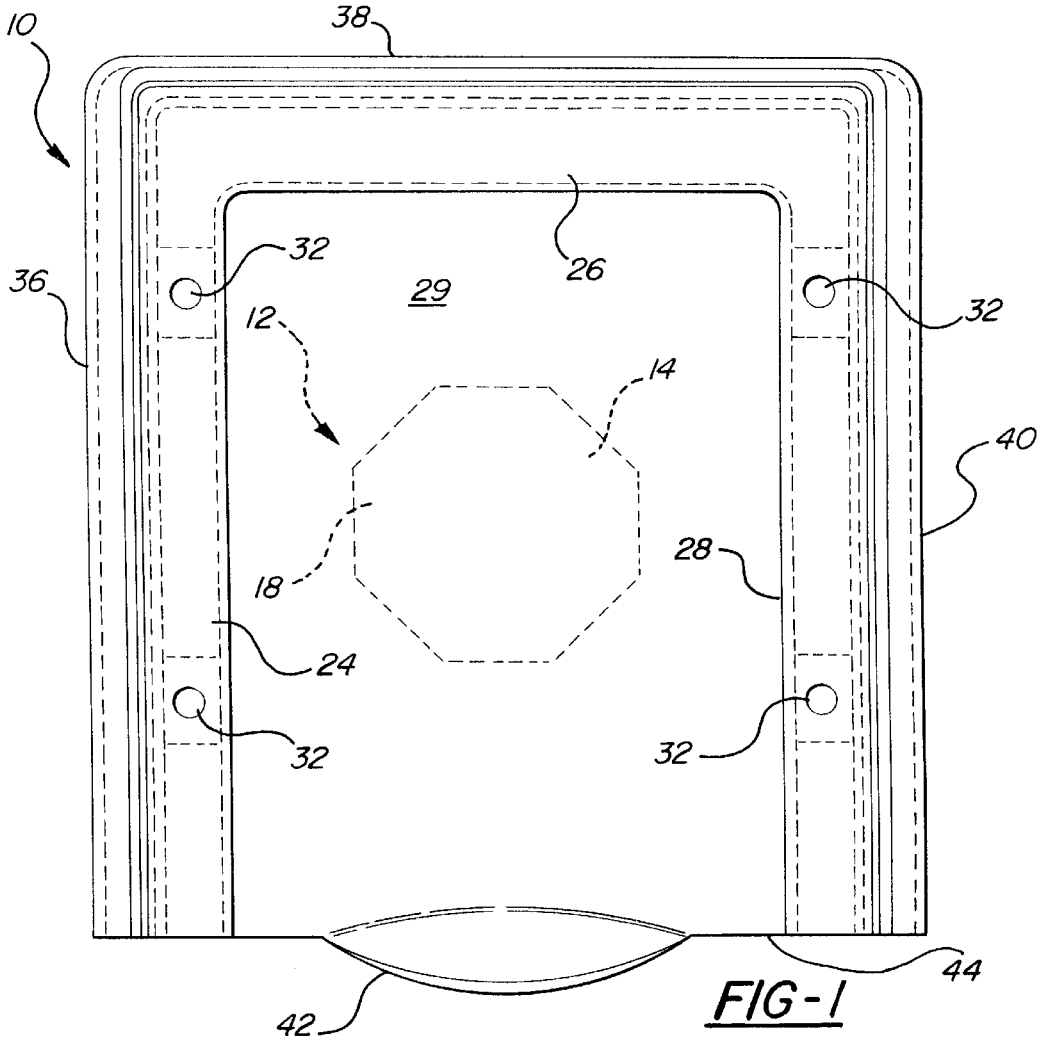
FIG. 1 is a frontal view of the improved alarm activation station protector according to a first preferred embodiment of the present invention.

Referring to FIGS. 1–4, an improved alarm station protector 10 is shown according to a first preferred embodiment of the present invention for use with a wall mounted activating alarm 12. The activating alarm 12 preferably includes a depressible member 14 which is attached to and extends from the alarm 12 by a stem portion 16 (see FIGS. 2 and 4). The depressible member 14 is, according to a particularly desirable embodiment, an octagonal shaped member having a form of a printed indicia 18 (FIG. 1) such as PUSH HERE imprinted thereon to notify a user as to how to activate the alarm. Other types of indicia such as FIRE, BURGLARY ALARM, etc., are additional examples of informative indicia which can be used to designate the application of the alarm. Also, other types of push buttons can be employed such as "EMERGENCY STOP" buttons and others.

Figure 2:
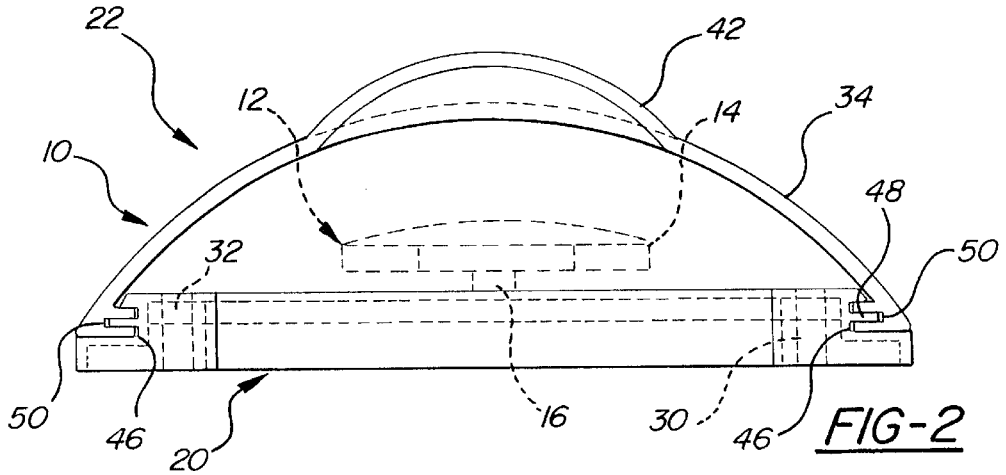
FIG. 2 is a top view of the alarm activation station protector shown in FIG. 1.
Figure 4:
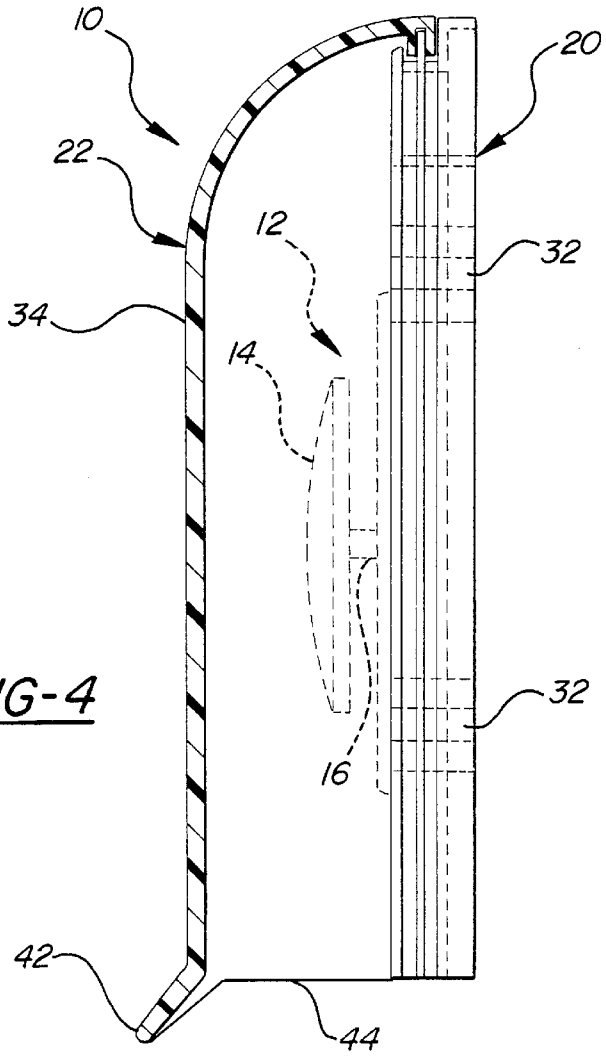
FIG. 4 is a side view of the alarm activation station protector as illustrated in the preferred embodiment of FIGS. 1–3 and showing the operative nature of the depressible alarm activating member contained within the protective cover.
Figure 3:
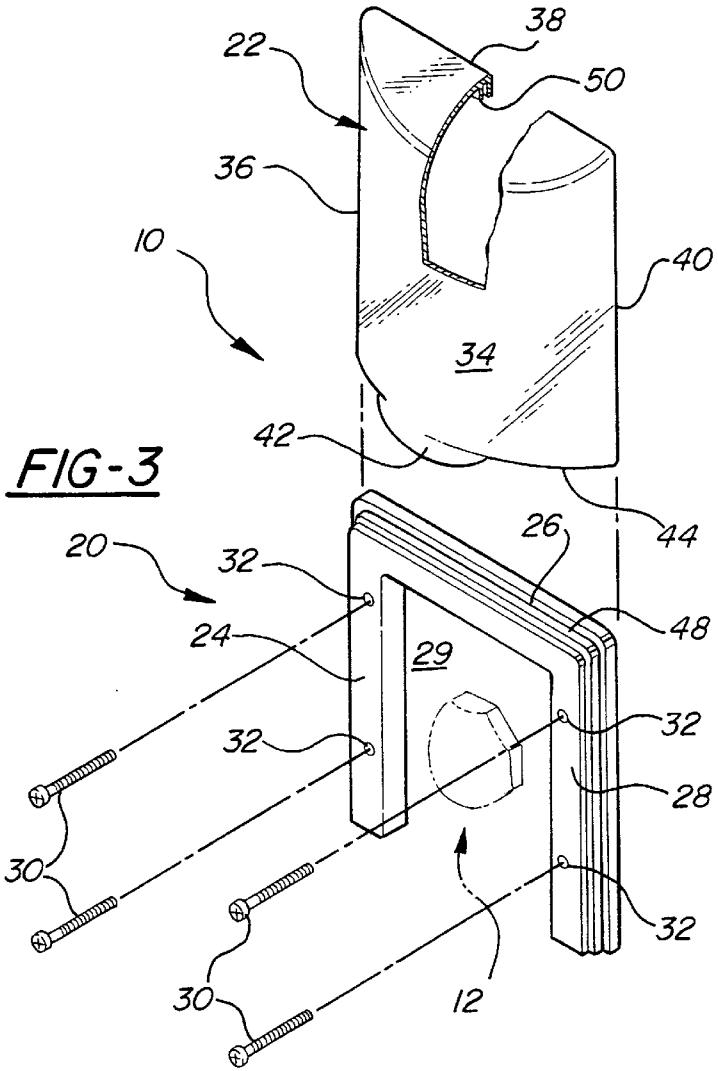
FIG. 3 is an exploded view in perspective of the alarm activation station protector according to the first preferred embodiment and illustrating the slidably engageable nature of the transparent cover relative to the wall mounted frame member.

As is best illustrated in FIG. 2, the alarm station protector 10 is made up primarily of a wall mounted frame member 20 and a slidably engageable protective cover member 22. The wall mounted frame member 20 is preferably constructed of a lightweight metal or durable plastic and is preferably U-shaped with a first side 24, a second side 26 and a third side 28 and defines a centrally open area 29 for receiving the alarm 12 and depressible member 14. A plurality of screw fasteners 30 are inserted through holes in the frame member 20, as illustrated at 32 in sides 24 and 28, and mount the frame member 20 to the wall surface at the desired location.

The protective cover member 22 includes a substantially clear or transparent body 34 constructed of a clear and durable plastic or like material and which is shaped in an outward and arcuate fashion. The cover member 22 includes a first frame member engaging side 36, a second frame member engaging side 38 and a third frame member engaging side 40. A downwardly and outwardly angled lip 42 extends from a bottom surface 44 of the cover member body 34. The dimensions of the cover member 22 are such that it is slidably engaged over the mounted frame member 20 and the body surface 34 is displaced sufficiently outwardly from the associated wall surface so that there is adequate clearance between an inner surface of the body 34 and the projecting depressible alarm member 14 or similarly positioned push button.

Slidably interlocking means are provided for maintaining engagement between the slidable cover member 22 and the fixed frame member 20 and include a projection and recess arrangement extending around a periphery of both the mounted frame member 20 and cover member 22. As is best illustrated in the top view in FIG. 2, a channeled recess 46 extends longitudinally along an outer face of the sides 24, 26 and 28 which make up the outer periphery of the mounted frame member 20. Projecting radially outwardly along the sides 24, 26 and 28 of the channeled recess 46 is a projecting tab portion 48.

Extending along the frame member engaging sides 36, 38 and 40 of the cover member 22 is an inwardly facing receiving track 50 which is U-shaped in cross section and which receives the projecting tab portion 48 extending around the periphery of the mounted frame member 20 in a sliding and interengaging fashion. With particular reference to the illustrations in FIGS. 2 and 3, the manner in which the cover member 22 slidingly engages over the mounted frame member 20 in both upwardly and downwardly actuable directions is clearly illustrated.

In use, the extending lip portion 42 of the cover member is either grasped by an individual having the use of his or her fingers or, alternatively, is pushed upwardly by a stubbed hand or arm of a disabled person. The inwardly facing receiving track 50 extending along the frame member engaging side 38 disengages upwardly from the protecting tab portion 48 in the upper and interconnecting side 26 of the frame member 20 and the interconnected receiving tracks 50 in the sides 36 and 40 slidably translates upwardly along the associated projecting tab portions 48 extending from the sides 24 and 28. The alarm activating member 14 is then depressed to set off the alarm once the cover member 22 is actuated upwardly a sufficient vertical distance to reveal the alarm 12 or push button. Once the alarm 12 is activated, the cover member 22 is simply released, upon which it slidingly descends back downwardly until the upper horizontally extending track 50 is once again in abutting engagement with the associated tab portion 48.

Figure 5:
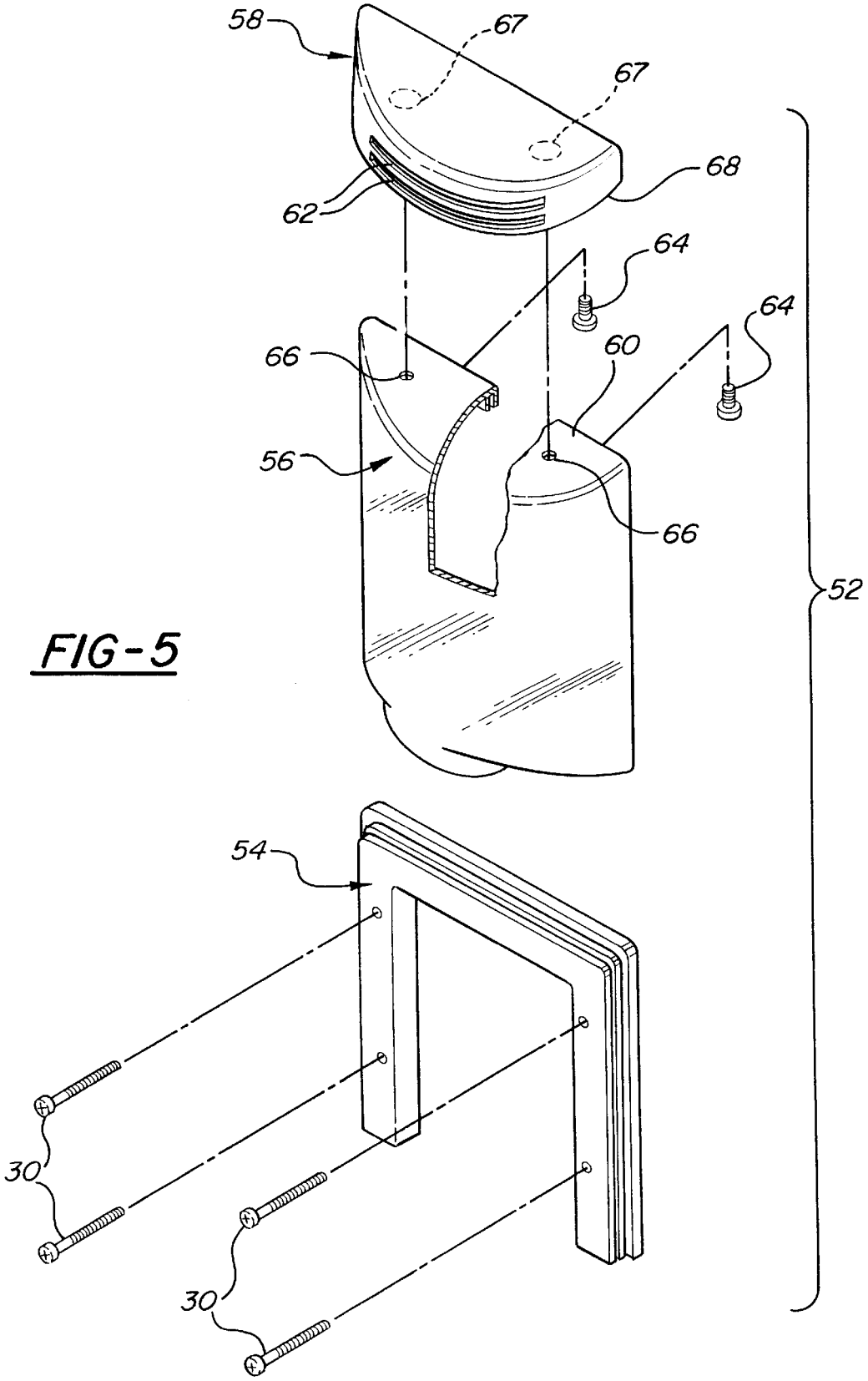
FIG. 5 is an exploded view similar to that shown in FIG. 3 of an alarm activation station protector according to a further preferred embodiment of the present invention.

Referring now to FIG. 5, a further modified embodiment 52 of the improved alarm station protector is shown according to the present invention and includes a wall mounted frame member 54 and an upwardly slidable cover member 56 substantially as previously described. The frame member 54 is mounted to a wall surface surrounding an alarm unit (not shown) in the same fashion utilizing the plurality of screw fasteners 30 which extend through apertures in the frame member and the underlying wall surface.

The modified embodiment 52 of the present invention further includes a horn assembly 58 which is either mounted to or is integrally formed with a top surface 60 of the cover member 56. The horn assembly 58 includes a plurality of sound emitting louvers 62 arranged along a front face thereof and incorporates a self-contained alarm emitting unit as is conventionally known in the art.

The purpose of the horn assembly 58 is to activate and emit a piercing sound upon the cover member 56 being slidably engaged upwardly relative to the mounted frame member 54 which surrounds the alarm. A pair of electrically conductive members in the form of metal bolts 64 can be secured to a fixed surface, such as a bracket extending outwardly from the wall surface (not shown) so that the bolts 64 will project upwardly through recesses 66 from the top surface 60 of the cover member 56 when the cover member 56 is positioned in a downward, non-actuated position. The bolts 64 are preferably in electrically conductive communication with each other.

While not evident from the view of FIG. 5, electrical contact points 67 may be formed in an underside 68 of the horn assembly 58 in alignment with the through recesses 66. Therefore, when the cover member 56 is in a downward, non-actuated position, the metal bolts 64 project upwardly through recesses 66 and abut the electrical contact points 67 formed in the underside 68 of the horn assembly 58. Upon actuating the cover member 56 and horn assembly 58 upwardly, the contact points 67 of the horn assembly 58 are removed from contact with abutting ends of the bolts 64. The circuitry within the horn assembly 58 is easily designed such that, upon opening the circuit by upwardly actuating the cover and horn assembly, a resulting open or closed circuit causes the horn assembly to emit a high pitched alarm sound. In most instances, both a power supply and loudspeaker output are incorporated into the horn assembly 58 to provide for ease of operation. The intended effect of the horn assembly 58 is to deter pranksters and vandals who would intend to harm or otherwise deface the cover assembly without intending to activate the main alarm.

Figure 6:
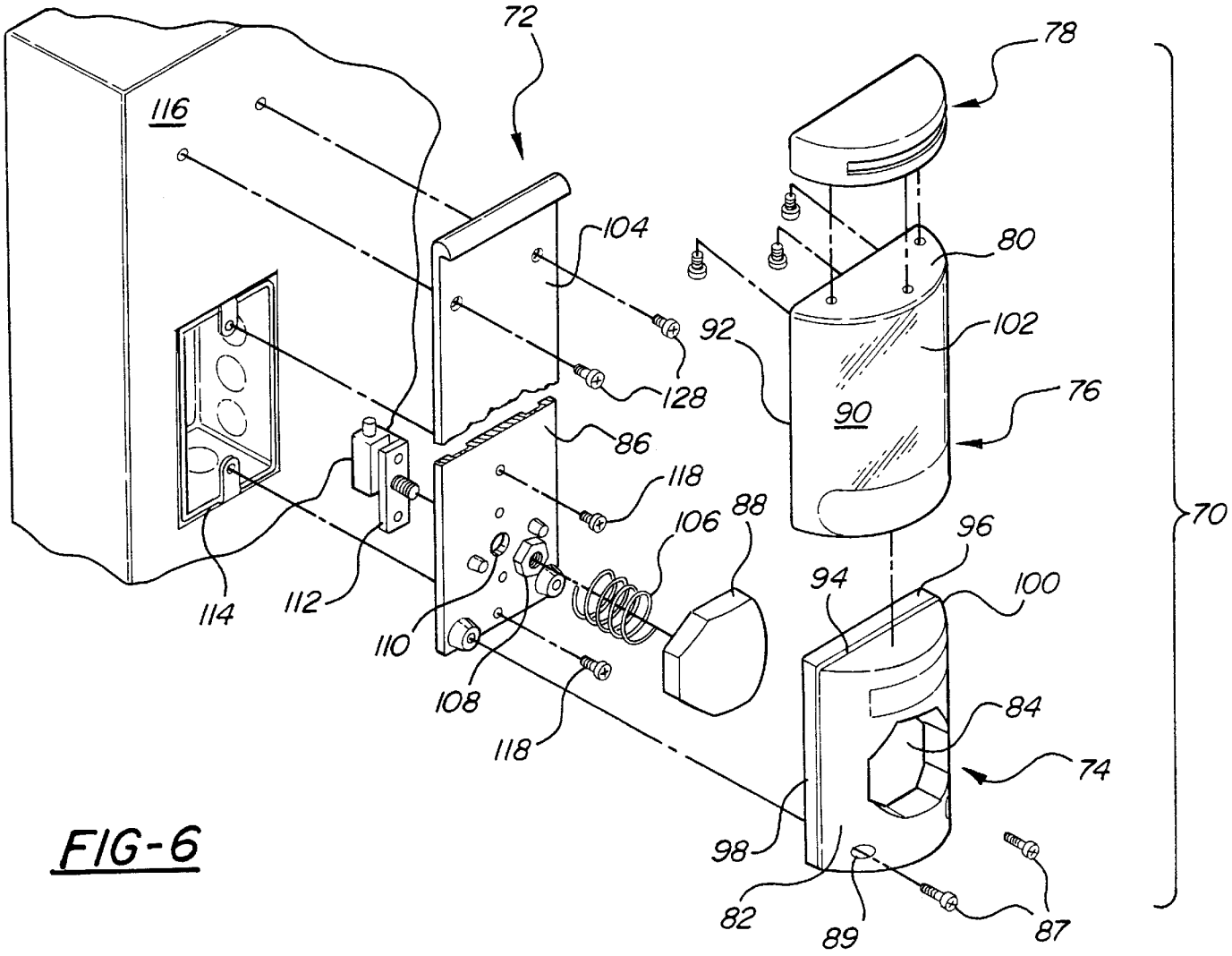
FIG. 6 is an exploded view of an alarm activation station protector according to yet a further preferred embodiment and illustrating in greater detail the arrangement and placement of the protector over a depressible alarm activating assembly.

Referring now to FIG. 6, another preferred embodiment 70 of the improved alarm station protector is shown for use with a wall mounted alarm activating assembly 72 according to the present invention. The station protector 70 of to this embodiment includes a wall mounted frame member 74, an upwardly slidably affixed cover member 76 and a horn assembly 78 secured to a top most end 80 of the cover member 76.

The frame member 74 according to this embodiment includes a body 82 which is substantially semi-cylindrical in shape and an aperture 84 which is formed in the body 82 so that, upon mounting the frame member 74 to a backing plate 86 of the alarm assembly 72 by bolts 87 extending through apertures 89 in the frame member 74, a depressible alarm activating member 88 of the alarm assembly 72 is received through the aperture 84. As is illustrated in all of the preferred embodiments, the shape of the alarm activating member 88 is that of an octagon and this shape has been found to be particularly desirable for providing ease of use by a disabled person and for quickly identifying the nature of the assembly. It is however understood that any other polygonal or circular shaped depressible member may alternatively be employed without deviating from the scope of the invention.

The slidable cover member 76 is also semi-cylindrically shaped in a fashion so as to closely overlay the wall mounted frame member 74 and includes a clear and heavy duty plastic or polycarbonate shield 90 which is surrounded by a frame 92. A projecting tab 94 may extend around a top 96 and first and second sides 98 and 100 of the wail mounted frame member 74 and is received within a track 102 similar in shape to that provided in the earlier preferred embodiments and formed in an inwardly facing manner along sides and a top of the cover member 76.

As is best illustrated in FIG. 6, the track 102 is evident through the shield 90 along a side of the cover member 76 corresponding to the side 100 of the wall mounted member. However it is to be understood that the tab 94 and track 102 extend around the top and sides of the wall mounted member 74 and cover member 76. It is also envisioned that the cover member 76 could alternatively be slidably mounted to appropriately configured backing plates of the alarm assembly 72, such as the plate 86 and an associated plate 104, so that the cover member 76 is slidably movable relative to the underlying wall mounted frame member 74 without actually being held in contact in any fashion with the frame member 74. The horn assembly 78 operates in the same fashion as that disclosed in the embodiment of FIG. 5 and functions, upon upwardly actuating the cover member 76, to issue a piercing alarm signal independently of that provided by the alarm assembly 72.

As is further illustrated in FIG. 6, the depressible alarm activating member 88 is mounted to the backing plate 86 by a spring-loaded stem arrangement 106 so that the alarm member 88 may be depressed inwardly through the aperture 84 in the frame member 74. A switch retaining nut 108 is secured over an aperture 110 in the backing plate 86 and an activation switch assembly 112 is mounted to a rear face of the plate 86. The switch assembly 112 activates the alarm upon depressing the octagonally shaped activating member 88. The assembly 112 is contained within an inwardly recessed electrical outlet box 114 formed at a desired location within a wall 116 upon the insertion of fasteners 118 and 120 formed in the backing plates 86 and 104.

As is set forth in the various embodiments, the present invention discloses an improved alarm station protector which is designed so as to comply with the American with Disabilities Act (ADA) to provide a disabled person the ability to activate an emergency system alarm. Although not shown in the drawings, the improved alarm station protector may further include identifying indicia according to different color schemes such as red to designate a fire alarm, green for an exit alarm, blue for other types of emergency and yellow for extinguishing systems.

Figure 7:
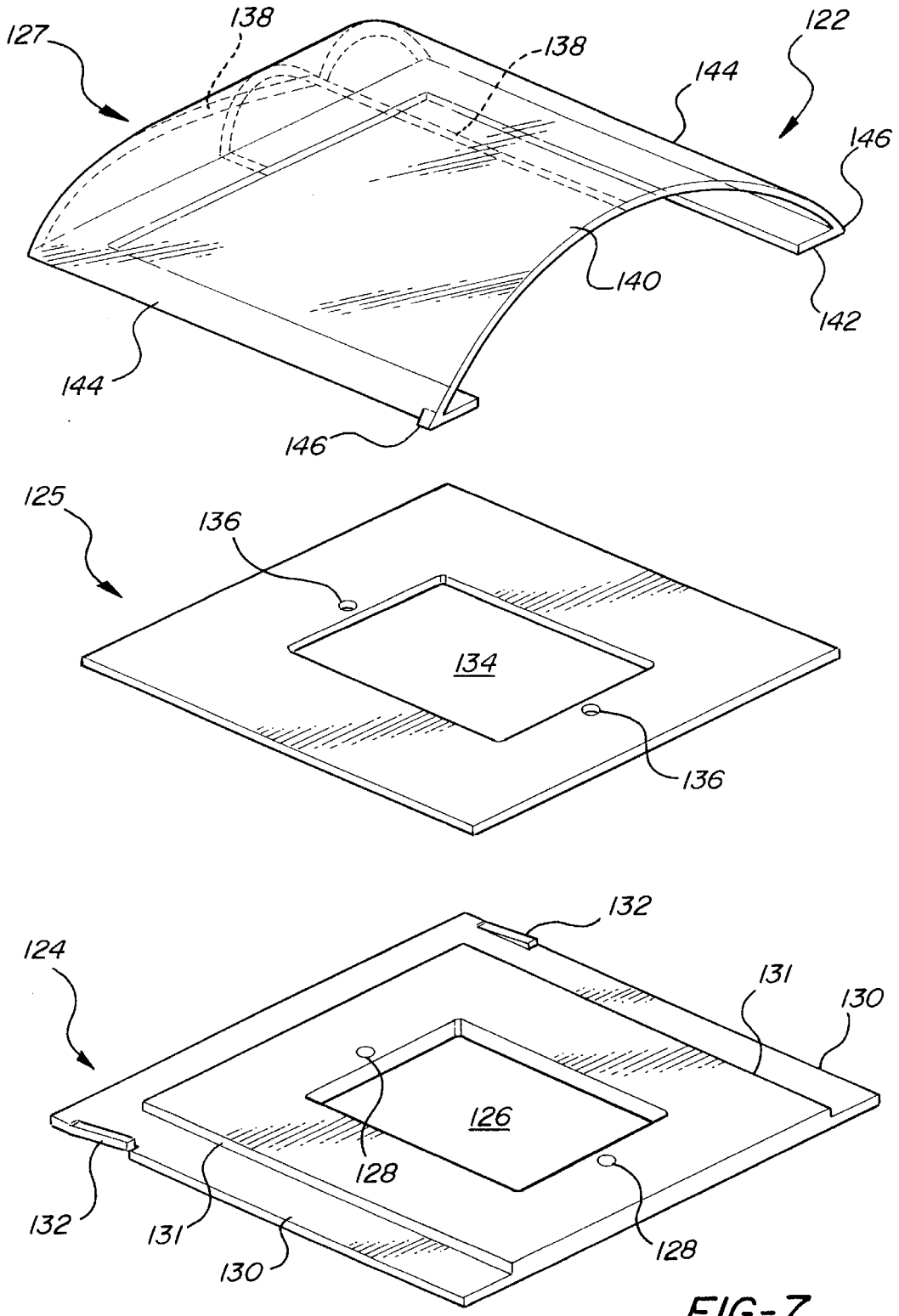
FIG. 7 is an exploded view of a yet further preferred embodiment of an alarm activation station protector according to the present invention.

Referring now to FIG. 7, an alarm activation station protector 122 is shown according to a yet further preferred embodiment and includes a three-piece construction which is made up of a bottom plate 124, a top plate 125 and a transparent shielding cover 127 which includes internal reinforcement. The bottom plate 124 and top plate 125 form in combination the equivalent of the wall mounted frame member described in the earlier embodiments and are illustrated in more detail with reference to FIGS. 8*a*–8*c* and 9*a*–9*c*. The cover 127 is also illustrated in FIG. 10 and is the equivalent of the protective covers likewise disclosed in the earlier preferred embodiments and is slidably connected to the assembled bottom plate 124 and top plate 125.

Figure 8A:
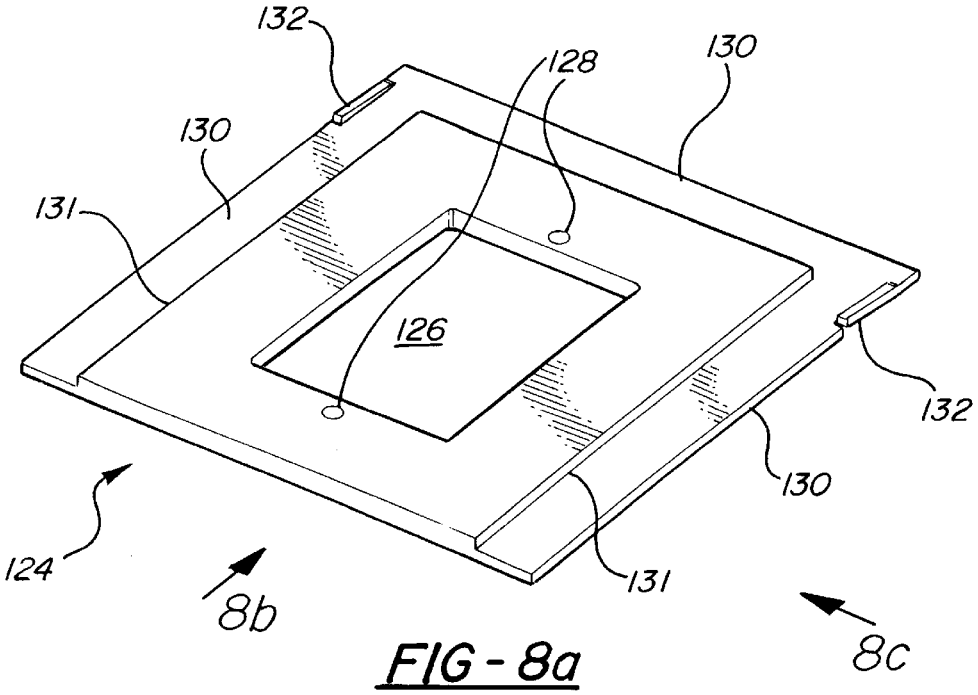
FIG. 8*a* is a sectional view of a bottom plate of the alarm activation station protector according to the embodiment of FIG. 7 and FIGS. 8*b* and 8*c* are further side views taken along lines 8*b*—8*b* and 8*c*—8*c* of the bottom plate of FIG. 8*a;*
Figure 8B:
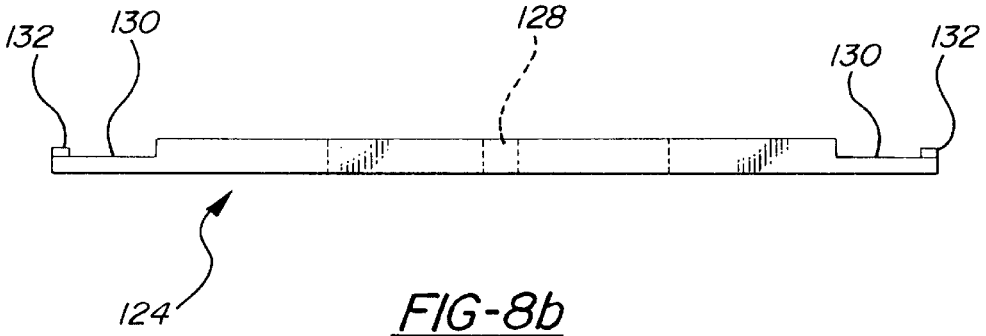
Figure 8C:
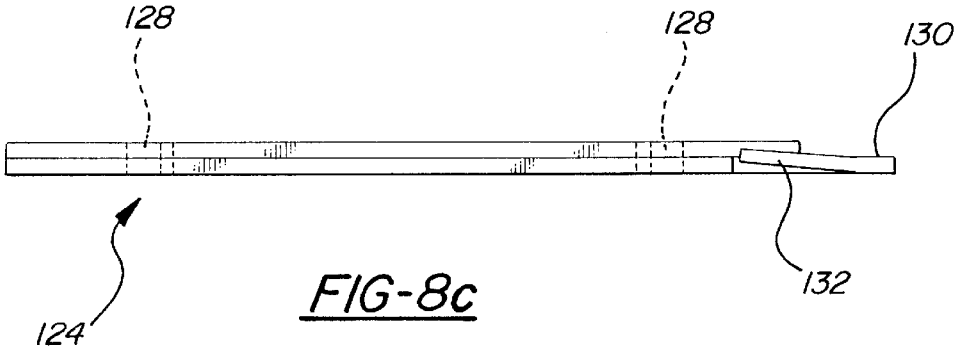

Referring again to FIGS. 7 and 8*a*, the bottom plate 124 is illustrated as being substantially rectangular in shape and includes a centrally formed and rectangular aperture 126 for surrounding the alarm member (not shown) which is mounted to the wall surface. A pair of apertures 128 are formed through the bottom plate 124 at opposite ends of the rectangular aperture 126 and receive conventional mounting fasteners for mounting the base plate at the desired overlaying position upon the wall surface. An outer framing lip 130 extends vertically along opposite sides of the bottom plate and is downwardly recessed at both sides by a stepped vertical wall as is indicated at 131. Situated proximate to an upper end of each lip 130 is an elongated gripping as member 132 for preventing further upwardly sliding motion of the cover 127 as will be subsequently described. Referring further to FIGS. 8*b* and 8*c*, side profiles of the bottom plate 124 are illustrated which show the relatively thin nature of the plate 124.

Figure 9A:
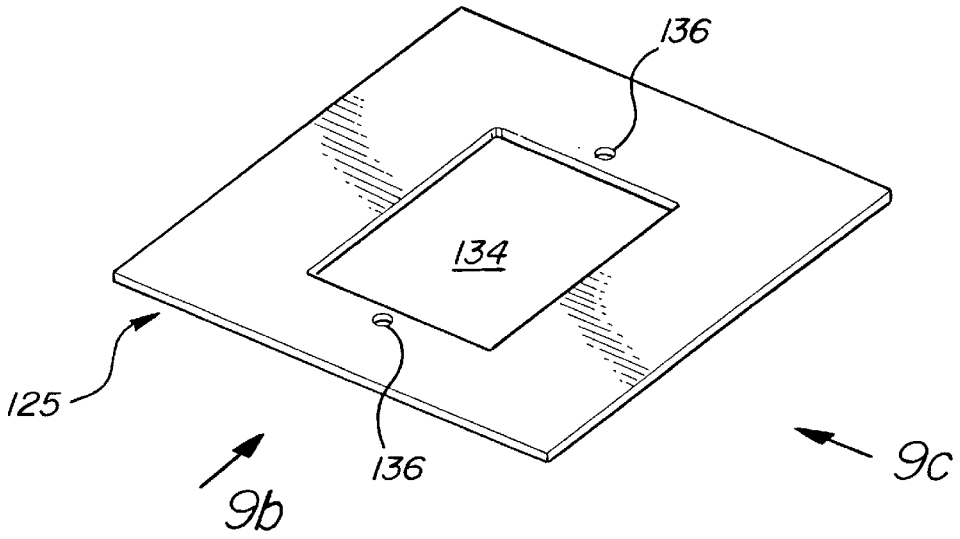
Figure 9B:
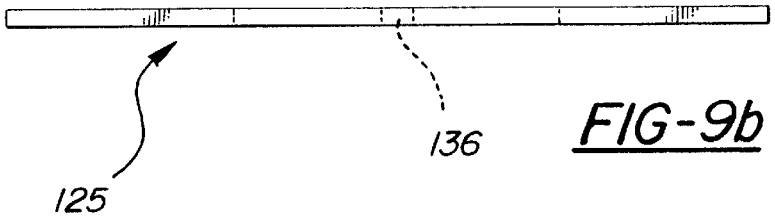
Figure 9C:
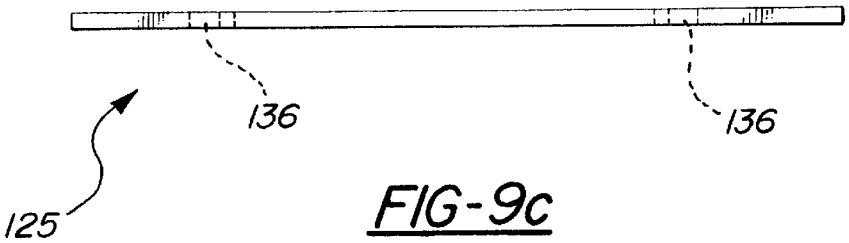

Referring again to FIG. 7 and further to FIGS. 9*a*–9*c*, the top plate 125 is again shown and includes a likewise rectangular apertured portion 134 and a pair of further apertures 136. The apertures 134 and 136 align with the apertures 126 and 128 of the bottom plate 124 upon assembly of the top plate 125 over the bottom plate 124. FIGS. 9*b* and 9*c* further show the flattened cross sections of the top plate 125 which are similar to those of the bottom plate 124.

Figure 10:
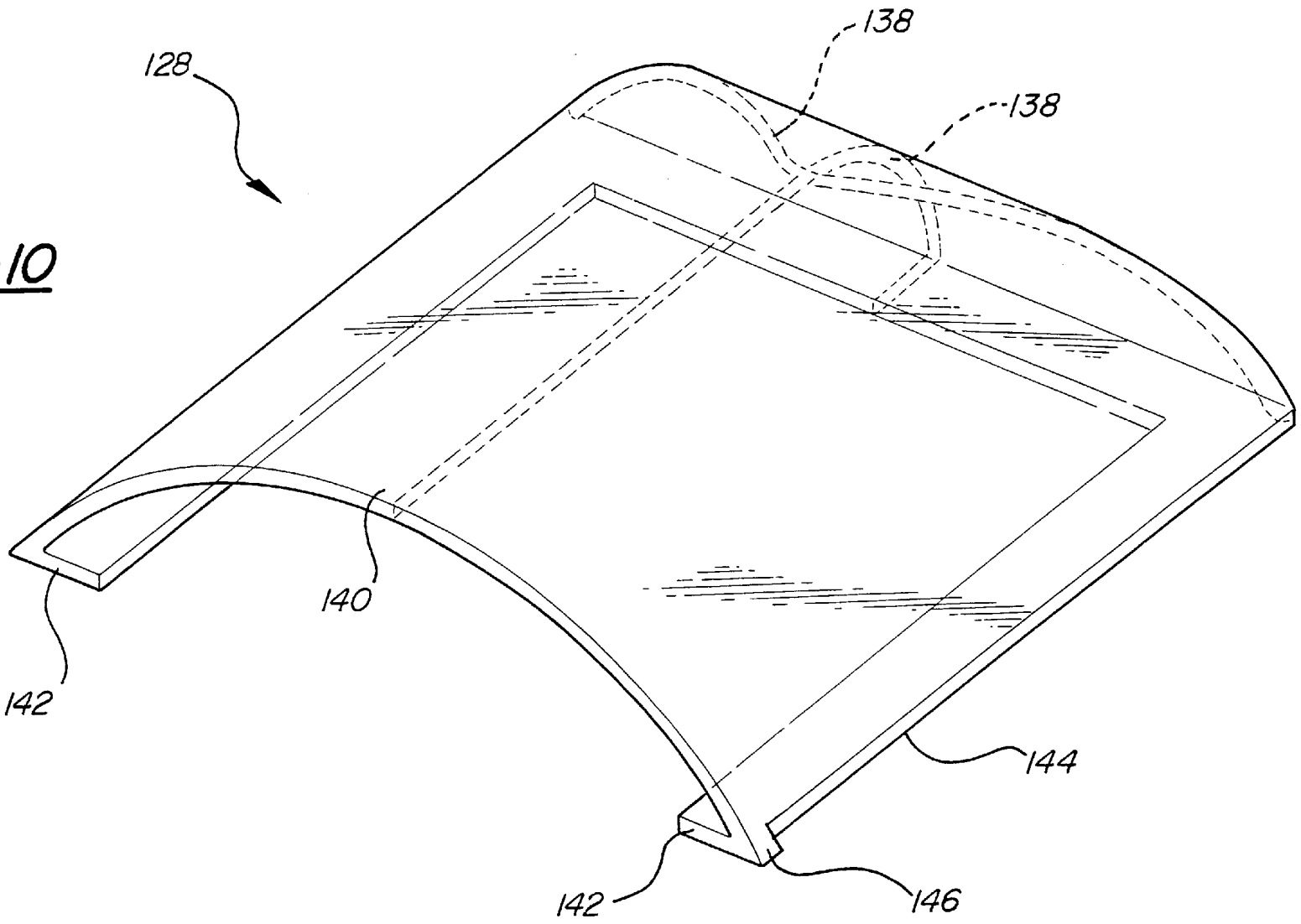
* and FIG. 10 is a view of a slidable cover member according to the further preferred embodiment of FIG. 7.

Finally, referring again to FIG. 7 and also to FIG. 10 the transparent shielding cover 127 is again illustrated and includes a plurality of lengthwise and crosswise elongated reinforcing members 138 around which is mounted or integrally formed a clear shielding member 140. The reinforcing members protect the underlying alarm member while the integrally formed shielding member 140 allows a clear view of alarm member.

The shielding cover 127 further includes a pair of downwardly extending legs 142 with flattened or planar rear faces which are contoured to abut the surfaces of the laterally outwardly facing edges of the outer flaming lips of the bottom plate 124 and to seat laterally within the recesses 131 on both sides of the bottom plate 124. The legs 142 are thus seated between the outwardly facing walls on the bottom plate 124 which define the recesses 131 and the elongated gripping members 132. A slotted channel 144 is formed along a lower outer face of each leg 142 and terminates at an upper end in an outwardly notched portion 146. The notched portions 146 are designed so that they engage the elongated gripping members 132 upon the cover 127 being slidably engaged upwardly to substantially a fully elevated position. As is further discussed with relation to the other embodiments, appropriate alarm circuitry can be incorporated into the alarm activation assembly according to is embodiment to issue a local alarm in the instance of vandalism or pranksters.

It is therefore evident upon review of the detailed description, that the present invention teaches an improved station protector for an alarm which permits a disabled individual not having the use of his/her hands and/or fingers to upwardly actuate the slidable covering member and to depress the alarm activating member. It is also conceivable that the present invention can employ a visual display such as blinkers or flashing lights for warning the hearing impaired or can utilize braille notices for the visually impaired. Also, as per national code NFPA 72, the present invention can further provide additional physical or mechanical protection to the occupants of a building. Additional embodiments will become apparent to those skilled in the art to which it pertains without deviating from the scope of the appended claims.

I claim:

1. An improved alarm activation station protector capable of being accessed by individuals with varying degrees of hand and arm disability, said alarm station protector overlaying a wail mounted and depressible alarm activating member and comprising:

a wall mounted frame member including at least one side and a centrally open area for receiving the alarm activating member; and a substantially transparent protective cover and means for slidably engaging said protective cover to said wall mounted frame member between a first position in which said protective cover overlays and shields the alarm activating member and a second position in which said protective cover is slidably displaced away from and exposes the alarm activating member;

said protective cover capable of being slidably actuated by a disabled individual not having the use of hands or fingers.

2. The improved alarm activation station protector as described in claim 1, further comprising said wall mounted frame member being substantially U-shaped in cross section with a first side, a second side and a third side, a plurality of boles formed in said sides of said frame member and receiving a plurality of screw fasteners to mount said frame member.

3. The improved alarm activation station protector as described in claim 2, said protective cover further comprising an arcuately shaped body with a first frame member engaging side, a second frame member engaging side and a third frame member engaging side which correspond in dimension and arrangement to said first, second and third sides of said frame member.

4. The improved alarm activation station protector as described in claim 1, further comprising a horn assembly incorporated into said protective cover, said horn assembly including a plurality of sound emitting louvers formed in a front face thereof and activating means for activating said horn assembly upon upwardly sliding of said protective cover.

5. The improved alarm activation station protector as described in claim 1, said wail mounted frame member further comprising a top plate and a bottom plate and said protective cover further comprising a plurality of elongated and cross-wise arranged and integrally formed reinforcing members.

6. An improved alarm activation station protector capable of being accessed by individuals with varying degrees of hand and arm disability, said alarm station protector overlaying a wall mounted and depressible alarm activating member and comprising:

a wall mounted frame member being substantially U-shaped in cross section with a first side, a second side and a third side, and a centrally open area for receiving the alarm activating member, a plurality of holes formed in said sides of said frame member and receiving a plurality of screw fasteners to mount said frame member and;

a substantially transparent protective cover and means for slidably engaging said protective cover to said wall mounted frame member between a first position in which said protective cover overlays and shields the alarm activating member and a second position in which said protective cover is slidably displaced away from and exposes the alarm activating member, said protective cover further comprising an arcuately shaped body with a first frame member engaging side, a second frame member engaging side and a third frame member engaging side which correspond in dimension and arrangement to said first, second and third sides of said frame member, said protective cover further comprising a downwardly and outwardly extending angled lip extending from a bottom surface of said cover, said means for slidably engaging said protective cover to said wall mounted frame further comprising a channeled recess extending longitudinally along a series of outer faces defined in said first, second and third sides of said frame member, and a projecting tab portion extending radially outwardly from said channeled recess along said first, second and third sides;

said protective cover capable of being slidably actuated by a disabled individual not having the use of hands or fingers.

7. The improved alarm activation station protector as described in claim 6, said means for slidably engaging said protective cover to said wall mounted frame further comprising an inwardly facing receiving track extending along said first, second and third frame member engaging sides of said protective cover, said track defining a substantially U-shape in cross section and receiving said protecting tab portion. protective cover including a clear and heavy duty durable plastic shield surrounded by a frame.

8. An improved alarm activation station protector capable of being accessed by individuals with varying degrees of hand and arm disability, said alarm station protector overlaying a wall mounted and depressible alarm activating member and comprising:

a wall mounted frame member including at least one side and a centrally open area for receiving the alarm activating member, said wall mounted frame member further comprising a top plate and a bottom plate comprising a pair of recessed outer framing lip; and a substantially transparent protective cover comprising a plurality of elongated and cross-wise arranged and integrally formed reinforcing members and first and second vertically extending legs with planar bottom surfaces which abut said outer framing lips and seat within said bottom plate, and means for slidably engaging said protective cover to said wall mounted frame member between a first position in which said protective cover overlays and shields the alarm activating member and a second position in which said protective cover is slidably displaced away from and exposes the alarm activating member;

said protective cover capable of being slidably actuated by a disabled individual not having the use of hands or fingers.

9. The improved alarm activation station protector as described in claim 8, further comprising said outer framing lips each having a vertical wall defining each said recess and an elongated gripping tab form ed at a laterally outward extremity of each of said outer lateral sides of said bottom plate, each of said legs of said cover further include an outwardly facing channeled portion for receiving said gripping tabs and an outwardly notched portion for engaging said gripping tabs at and upwardly slidably elevated position and preventing said cover from becoming slidably disengaged from said bottom plate.

10. An improved alarm activation station protector capable of being accessed by individuals with varying degrees of hand and arm disability, said alarm station protector overlying a wall mounted and depressible alarm activating member and comprising:

a wall mounted frame member including at least one side and a centrally open area for receiving the alarm activating member, said frame member being substantially U-shaped in cross section with a first side, second side and a third side, a plurality of holes formed in said sides of said frame member and receiving a plurality of screw fasteners to mount said frame member; and a substantially transparent protective cover, said cover having a arcuately shaped body with a first frame member engaging side, a second frame member engaging side and a third frame member engaging side which correspond in dimension and arrangement to said first, second, and third sides of said frame member, a downwardly and outwardly extending angled lip extending from a bottom of said cover, and means for slidably engaging said protective cover to said wall mounted frame member between a first position in which said protective cover overlays and shields the alarm activating member and a second position in which said protective cover is slidably displaced away from and exposes the alarm activating member;

said protective cover capable of being slidably actuated by a disabled individual not having the use of hands and fingers.

11. An improved alarm activation station protector capable of being accessed by individuals with varying degrees of hand and arm disability, said alarm station protector overlying a wall mounted and depressible alarm activating member and comprising:

a wall mounted frame member being substantially U-shaped in cross section with a first side, second side and a third side, a plurality of holes formed in said sides of said frame member and receiving a plurality of screw fasteners to mount said frame member, said frame member including at least one side and a centrally open area for receiving the alarm activating member, said centrally open area of said frame member being an aperture conforming in outline to the depressible alarm activating member; and a substantially transparent protective cover, said cover having a arcuately shaped body with a first frame member engaging side, a second frame member engaging side and a third frame member engaging side which correspond in dimension and arrangement to said first, second, and third sides of said frame member and means for slidably engaging said protective cover to said wall mounted frame member between a first position in which said protective cover overlays and shields the alarm activating member and a second position in which said protective cover is slidably displaced away from and exposes the alarm activating member, said protective cover including a clear and heavy duty durable plastic shield surrounded by a frame;

said protective cover capable of being slidably actuated by a disabled individual not having the use of hands and fingers;

said wall mounted frame member and said protective cover each have a substantially semi-cylindrically shaped body.

12. An improved alarm activation station protector capable of being accessed by individuals with varying degrees of hand and arm disability, said alarm station protector overlying a wall mounted and depressible alarm activating member and comprising:

a wall mounted frame member including at least one side and a centrally open area for receiving the alarm activating member; and a substantially transparent protective cover and means for slidably engaging said protective cover to said wall mounted frame member between a first position in which said protective cover overlays and shields the alarm activating member and a second position in which said protective cover is slidably displaced away from and exposes the alarm activating member;

said protective cover capable of being slidably actuated by a disabled individual not having the use of hands and fingers;

a horn assembly being securably attached to a top end of said protective cover, said horn assembly including a plurality of sound emitting louvers formed in a front face thereof and activating means for activating said horn upon sliding of said protective cover, said activating means having contact points formed in the underside of said horn assembly which are in electrical communication with electrically conductive members mounted to the wall surface, said horn assembly activating upon upward sliding of said protective cover so as to disengage said contact points from said members and to open a circuit established therebetween.

* * * * *

UNITED STATES PATENT AND TRADEMARK OFFICE

CERTIFICATE OF CORRECTION

PATENT NO. : 5,955,939

DATED : Sept. 21, 1999

INVENTOR(S) : John F. Taylor

It is certified that error appears in the above-indentified patent and that said Letters Patent is hereby corrected as shown below:

Front Page, Inventor - Replace "John A. Taylor" with --John F. Taylor--

Front Page, Abstract - Replace "NHFPA 72" with --NFPA 72--

Column 1, line 9 - Replace "watt" with --wall--

Column 1, line 20 - Replace "unit " delete --as--

Column 2, line 12 - Replae "filly" with --fully--

Column 6, line 36 - After "gripping" delete --as--

Column 6, line 62 - Replace "flaming" with --framing--

UNITED STATES PATENT AND TRADEMARK OFFICE

CERTIFICATE OF CORRECTION

PATENT NO. : 5,955,939

DATED : Sept. 21, 1999

INVENTOR(S) : John F. Taylor

It is certified that error appears in the above-indentified patent and that said Letters Patent is hereby corrected as shown below:

Column 7, line 8 - Replace "is" with --this--

Column 7, line 49 - Replace "boles" with --holes--

Column 8, line 62 - Replace "lip" with --lips--

Column 8, line 50 - Replace "protecting" with --projecting--

Column 8, line 51-52 - Delete "protective cover including a clear and heavy duty durable plastic shield surrounded by a frame."

Column 9, line 14 - Relace "form ed" with --fored-- Column

Signed and Sealed this

Seventeenth Day of April, 2001

*Attest:*

Nicholas P. Godici

NICHOLAS P. GODICI

*Attesting Officer*

*Acting Director of the United States Patent and Trademark Office*